US010209004B2

(12) United States Patent
Lochner et al.

(10) Patent No.: US 10,209,004 B2
(45) Date of Patent: Feb. 19, 2019

(54) METHOD FOR OBTAINING AN AIR PRODUCT IN AN AIR SEPARATION PLANT AND AIR SEPARATION PLANT

(71) Applicant: LINDE AKTIENGESELLSCHAFT, Munich (DE)

(72) Inventors: Stefan Lochner, Grafing (DE); Ralph Spöri, Geretsried (DE); Christian Zimmermann, Holzkirchen (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 148 days.

(21) Appl. No.: 15/397,890

(22) Filed: Jan. 4, 2017

(65) Prior Publication Data

US 2017/0205142 A1 Jul. 20, 2017

(30) Foreign Application Priority Data

Jan. 14, 2016 (EP) ..... 16000084

(51) Int. Cl.
*F25J 3/04* (2006.01)

(52) U.S. Cl.
CPC ..... *F25J 3/04848* (2013.01); *F25J 3/0409* (2013.01); *F25J 3/04018* (2013.01); *F25J 3/0443* (2013.01); *F25J 3/04048* (2013.01); *F25J 3/0489* (2013.01); *F25J 3/04163* (2013.01); *F25J 3/04284* (2013.01); *F25J 3/04309* (2013.01); *F25J 3/04321* (2013.01); *F25J 3/04381* (2013.01);

(Continued)

(58) Field of Classification Search
CPC .... F25J 3/04084; F25J 3/04781; F25J 3/4872; F25J 3/04048; F25J 3/0409; F25J 3/04103; F25J 3/04284; F25J 3/0443; F25J 3/04412; F25J 3/04527; F25J 3/04842; F25J 2200/94; F25J 2220/50; F25J 2245/02; F25J 2280/30
See application file for complete search history.

(56) References Cited

U.S. PATENT DOCUMENTS 5,148,680 A * 9/1992 Dray ..... F25J 3/04084 62/646
2009/0107177 A1 4/2009 Lochner

FOREIGN PATENT DOCUMENTS

WO WO 2014173496 A2 * 10/2014 ..... F25J 3/04781

OTHER PUBLICATIONS

WO 2014173496 A2 Translation.*

* cited by examiner

*Primary Examiner* — Brian M King
(74) *Attorney, Agent, or Firm* — Millen White Zelano & Branigan, PC

(57) ABSTRACT

A method for obtaining an air product from an air separation plant having a distillation column system and a tank system. The tank system includes a first tank and a second tank. Cryogenic liquid is withdrawn from the distillation column system, stored in the tank system, and used as the air product. The cryogenic liquid is supplied to the first tank and withdrawn from the second tank during a first period, and is supplied to the second tank and withdrawn from the first tank during a second period. The tank system has a third tank to which cryogenic liquid withdrawn from the first tank and the second tank is transferred unheated. The air product is withdrawn from the third tank in liquid state, vaporized and discharged. Alternatively, the cryogenic liquid can be withdrawn from the third tank and stored in the liquid state in a fourth tank.

20 Claims, 2 Drawing Sheets

(52) U.S. Cl.
CPC ..... *F25J 3/04478* (2013.01); *F25J 3/04484* (2013.01); *F25J 3/04496* (2013.01); *F25J 3/04787* (2013.01); *F25J 3/04872* (2013.01); *F25J 2200/30* (2013.01); *F25J 2200/94* (2013.01); *F25J 2215/42* (2013.01); *F25J 2215/52* (2013.01); *F25J 2215/56* (2013.01); *F25J 2220/02* (2013.01); *F25J 2220/50* (2013.01); *F25J 2230/08* (2013.01); *F25J 2230/40* (2013.01); *F25J 2230/50* (2013.01); *F25J 2245/02* (2013.01); *F25J 2250/20* (2013.01); *F25J 2280/20* (2013.01); *F25J 2290/12* (2013.01); *F25J 2290/34* (2013.01); *F25J 2290/60* (2013.01); *F25J 2290/62* (2013.01)

METHOD FOR OBTAINING AN AIR PRODUCT IN AN AIR SEPARATION PLANT AND AIR SEPARATION PLANT

The invention relates to a method for obtaining an air product in an air separation plant, and to an air separation plant designed for carrying out such a method.

PRIOR ART

The production of air products in liquid or gaseous form by cryogenic separation of air in air separation plants is known and described for example in H.-W. Häring (Ed.), Industrial Gases Processing, Wiley-VCH, 2006, in particular section 2.2.5, "Cryogenic Rectification".

Compressed oxygen is required for a range of industrial uses, and in order to produce it use can be made of air separation plants with what is referred to as internal compression. Air separation plants of this kind are also described, for example, in Häring and are explained with reference to FIG. 2.3A therein. In such separation plants, a cryogenic liquid, in particular liquid oxygen, which is pressurized in the cryogenic liquid state, is vaporized against a heat transfer medium and is finally discharged as a pressurized gas product. The internal compression has, inter alia, energetic advantages in comparison to subsequent compression of a product which already exists in gas form.

In that context, there is no phase transition proper at supercritical pressure; the cryogenic liquid is instead brought from the liquid state into a supercritical state. The terms "pseudo-vaporization" or "de-liquefaction" are also used in this context. The cryogenic liquid which is brought from the liquid state into the supercritical state liquefies the heat transfer medium which is at high pressure(or, as the case may be, "pseudo-liquefies" the latter if it is at supercritical pressure). The heat transfer medium is frequently formed by part of the air supplied to the air separation plant.

The present explanations can also be used as appropriate for other air products such as nitrogen or argon, which can also be obtained in the gaseous or supercritical state by using internal compression and are previously present as cryogenic liquids.

In order to increase the pressure of air products in air separation plants, it is known to use what is termed pressurization compression, which is for example described in DE 676 616 C and EP 0 464 630 A1. As disclosed for example in U.S. Pat. No. 6,295, 840B1, an air product can also be stored in a tank system, and pressurized there, by means of a partial flow of compressed feed air.

There is a need for improved possibilities for generating corresponding air products in air separation plants, in particular in air separation plants having the discussed tank systems.

DISCLOSURE OF THE INVENTION

Against this backdrop, the present invention proposes a method for obtaining an air product in an air separation plant and an air separation plant set up for carrying out such a method, having the features described herein. Preferred configurations are also provided in the following description.

The present application uses the terms "pressure level" and "temperature level" to characterize pressures and temperatures, these being intended to express that pressures and temperatures in a corresponding plant need not be used in the form of exact pressure or temperature values in order to realize the inventive concept. However, such pressures and temperatures typically move within certain ranges which lie for example ±1%, 5%, 10%, 20% or even 50% about a central value. In that context, corresponding pressure levels and temperature levels can lie in disjoint ranges or in overlapping ranges. In particular, pressure levels for example include unavoidable or expected pressure losses, for example due to cooling effects or pipe losses. The same holds for temperature levels. The pressure levels indicated here in bar are absolute pressures.

ADVANTAGES OF THE INVENTION

The present invention proposes a method for obtaining an air product using an air separation plant having a distillation column system and a tank system having a first tank and a second tank.

Within the context of the method according to the invention, a cryogenic liquid, for example pure oxygen or one of the other air products mentioned previously, is withdrawn from the distillation column system and at least partially stored in liquid form in the tank system. After a withdrawal from the tank system, the cryogenic liquid can be used as the air product. Within the context of the present invention, use is then made of a tank system having a first and a second tank which are alternately supplied with the cryogenic liquid. In other words, during a first period the cryogenic liquid is supplied to the first tank and not to the second tank, and during a second period to the second tank and not to the first tank. The alternating operation further involves that, during the first period the cryogenic liquid is withdrawn from the second tank and not the first tank, and during the second period from the first tank and not the second tank. Provision may also be made for using more than two tanks which are subjected to a corresponding cycle. However, these still comprise a first and a second tank and a corresponding supply or withdrawal in a first or second period, respectively.

Using a corresponding tank system makes it possible, in an internal compression method, to prepare a product with a specified purity, because the method permits the use of analysis methods that cannot be carried out continuously. In conventional internal compression methods, in which pressurization is effected using pumps, this is not possible since in this case the pump discharge stream is supplied continuously and directly to heating. Within the context of the method according to the invention, it is for example possible, after the first period, to verify the purity of the cryogenic liquid stored in the first tank, and to do the same to the liquid stored in the second tank after the second period. If this purity corresponds to a setpoint value, the cryogenic liquid is provided as the air product. If the purity does not match the setpoint value, a corresponding cryogenic liquid can be discarded or, advantageously, returned into the distillation column system.

However, alternating operation of this type results—in particular when switching between the tanks, i.e. between the first period and the second period or between the second period and first period, or if the tank contents cannot be provided as the air product for example due to unsatisfactory purity—in interruptions in the provision of the cryogenic liquid from the tank system, which ultimately translate into discontinuous production of the air product. This can result in problems for the consumers connected to a corresponding air separation plant, their supply being unsatisfactory, but also in problematic effects in a device possibly used for heating the cryogenic liquid, for example the primary heat exchanger of the air separation plant.

The present invention therefore proposes using, as the tank system, a tank system having an additional third tank, wherein the cryogenic liquid which is withdrawn from the second tank during the first period, and from the first tank during the second period, is transferred at least partially (and in particular at least temporarily) unheated into the third tank. In this context, it can also be provided to transfer, unheated, into the third tank only part of the cryogenic liquid which is withdrawn from the second tank during the first period and from the first tank during the second period, and to provide another part of the cryogenic liquid directly, as explained below, via a bypass as an air product or to use it in another form. In that context, the third tank serves as a receiver or buffer store which is filled with a suitable quantity of cryogenic liquid that is sufficient for bridging the periods explained above.

Transfer into the third tank is "unheated" if the cryogenic liquid which is withdrawn from the second tank during the first period and from the first tank during the second period is transferred at the withdrawal temperature level from the second or first tank into the third tank. This is the case if the cryogenic liquid undergoes no active temperature-increasing measures, or no heating. Thus, the cryogenic liquid is in particular not fed through any heat exchanger, heater, counter-current unit etc. for heating. As already stated above with regard to the term "temperature level", this does not exclude that unavoidable heat inputs might result in a certain, but not actively undertaken, heating. The term "temperature level" takes this into account, such that in the stated context the mentioned withdrawal temperature level can still be below a feed-in temperature level into the third tank. Unheated transfer into the third tank takes place in particular in order to avoid vaporization losses.

Thus, according to the invention, the cryogenic liquid which is stored in the first or the second tank is no longer—or not exclusively—removed therefrom and used as the air product. Rather, the air product is provided at least in part by using the cryogenic liquid transferred, unheated, into the third tank, or part of this. Within the context of the present invention, it is however also possible, as mentioned, to provide bypass lines which permit removal from the first or second tank, such that the air product can also be provided in part using the cryogenic liquid stored there but not transferred into the third tank. This makes it possible also for direct withdrawal from the first or the second tank to take place, for example if the third tank is entirely full and satisfactory purity has been established. It can moreover be provided that not all of the cryogenic liquid transferred unheated into the third tank is used for providing the air product. Part of the cryogenic liquid transferred unheated into the third tank can be withdrawn in the liquid state from the third tank and used otherwise. It is also possible that, for example, that fraction of the cryogenic liquid which has vaporized in the respective tank is not used to provide the air product.

It is also provided according to the invention that the cryogenic liquid from the third tank used for providing the air product is withdrawn from the third tank in the liquid state, is vaporized or converted from the liquid to the supercritical state, and is discharged from the air separation plant, and/or that the cryogenic liquid used for providing the air product is withdrawn from the third tank in the liquid state and is stored in the liquid state in a fourth tank.

The fourth tank can be part of the tank system with the first to third tanks, but it can also be provided separately, for example as part of a further tank system. The fourth tank can be located within the air separation plant, for example within a coldbox, or within a thermally insulating outer shell which also encloses the first to third tanks. The fourth tank can however also be arranged outside the air separation plant. Thus, within the context of the present invention, the air product may be an air product that is in the gaseous or in the supercritical state, and/or a liquid air product. Just like the liquid air product, the gaseous air product can also be stored within or outside the air separation plant, in particular in an appropriate gas tank.

Advantageously, the cryogenic liquid is withdrawn from the distillation column system of the air separation plant at a pressure level at which a corresponding column of the distillation column system, in particular a pure oxygen column, hereinafter also termed the "second separation column", is operated. The cryogenic liquid is supplied to the first tank and to the second tank of the tank system at a pressure level which is referred to here as the "first" pressure level. The first pressure level can correspond to the pressure level at which the cryogenic liquid has been withdrawn from the distillation column system, if no pressure-influencing devices such as pumps are arranged between the separation column and the first or second tank. If, for example, a corresponding pump is used, the first pressure level can also be above the pressure level of the separation column. The cryogenic liquid is supplied to the third tank of the tank system at a second, higher pressure level (storage pressure) which can in particular be determined on the basis of the pressure (product pressure) at which the air product is to be provided. The storage pressure is advantageously somewhat higher than the product pressure, such that discharge is possible without additional pumps or compressors. The second pressure level can in particular be achieved by performing pressurization vaporization in the first and/or second tank.

By using the disclosed tank system and a pressure increase, the present invention combines the advantages of a conventional internal compression method, namely the continuous production of the air product, with the advantages of improved analysis possibilities. This improved analysis possibility makes it possible, at any moment, to ensure and document high purity of the air product.

After withdrawal of the cryogenic liquid from the third tank (or from the first and second tanks via the above-mentioned bypass lines), this liquid can, as mentioned, in particular be vaporized or converted from the liquid state into the supercritical state, if a gaseous or supercritical air product is to be produced. Vaporization or conversion. into the supercritical state (for the sake of simplicity, the term "vaporization" will henceforth be used for both cases) can take place within the air separation plant used, for example using the main heat exchanger of this plant. For cases in which the air separation plant is not available, it is also possible to use a backup system having an emergency supply vaporizer which does not draw vaporization heat from the air separation plant. However, and as has also been mentioned, after withdrawal from the third tank (or from the first and second tanks via the above-mentioned bypass lines), the cryogenic liquid can also be discharged in liquid form from the air separation plant, transported in liquid form, for example in a tank, to a consumer, and used there in the liquid or (after vaporization) gaseous state.

Preferably, the first pressure level, that is to say the pressure level at which the cryogenic liquid is supplied to the first and second tanks, is approximately 1.3 to 4 bar. Depending on requirements, the second pressure level is between 2 and 100 bar, but above the first pressure level. Within the context of the present invention, it is possible for a pressure increase which is in particular flexible with regard to time to take place taking into account the pressure requirements of a consumer.

According to one embodiment of the invention, the cryogenic liquid can be brought to the first pressure level prior to feeding into the first tank and into the second tank using a pump. In this embodiment, the present invention combines the advantages of conventional internal compression methods using corresponding pumps, which, however, due to the continuous pressure increase do not make it possible to carry out discontinuous analysis methods, with methods in which different tanks are supplied in alternation.

The conventional methods, which are carried out using tank systems having two tanks, involve pressurization vaporization. In pressurization vaporization, a loss of product is unavoidable due to the fraction of a corresponding cryogenic liquid that is required for the pressure increase. This product loss can be as high as 10%. Using a pump reduces such a product loss. The flash losses in the tanks, which are unavoidable here, too, are approximately 5% and thus markedly lower than the losses due to pressurization vaporization. Even though a corresponding pump has an additional energy requirement, the higher product yield outweighs this possible additional energy requirement.

The invention then provides particular advantages in air separation plants which have very high purity requirements for the respective air product, for example oxygen. In the case of such very high purity requirements, conventional rapid (routine) analysis methods can approach the limit of detection and more sensitive analysis methods such as gas chromatography must be used. However, these more sensitive analysis methods require much more time to determine the measurement value than conventional methods, and so it is necessary to conduct discontinuous measurement.

In addition, the method according to the invention saves energy in comparison to methods in which vaporization of a corresponding air product, for example oxygen, takes place only at the consumer. Overall, it is possible to achieve energy savings in the region of 1 kW per Nm3/h.

The advantages associated with the present invention are of particular interest for smaller air separation plants whose capacity is limited by the maximum transport dimensions. An improvement in efficiency results in a corresponding increase in yield.

Although increasing the pressure of the cryogenic liquid by means of a pump — as previously mentioned— can be advantageous in certain cases, the present invention can also in principle be used to considerable advantage in corresponding tank systems having pure pressurization vaporization. This makes it possible to dispense with a pump entirely, which makes it possible to build a corresponding air separation plant more cost-effectively. The omission of moving or driven parts in pressurization vaporization permits particularly energy-efficient and low-maintenance operation. The vaporization losses resulting in the context of pressurization vaporization are inconsequential if a gaseous or supercritical air product is to be provided anyway. It is also possible to combine a pressure increase by means of a pump and an additional pressurization vaporization.

As already mentioned, the method according to the invention is particularly well-suited to the provision of high-purity air products because discontinuous analysis prior to heating and discharge to the plant boundary is possible. In other words, in the context of the present invention, a purity of the cryogenic liquid which is supplied during the first period to the first tank and during the second period to the second tank is advantageously determined. For a corresponding analysis, use can be made of established purity testing methods, for example spectroscopic methods and/or gas chromatography.

Within the context of the present invention, the cryogenic liquid is then advantageously transferred from the second tank to the third tank during the first period, and from the first tank to the third tank during the second period, only if its purity corresponds to a setpoint value. Thus, the third tank is always filled with cryogenic liquid of a defined purity, and can be used at any time for provision of the air product without additional analysis.

If the purity of the cryogenic liquid does not match the setpoint value, it can however advantageously be returned to the distillation column system from the second tank during the first period, and from the first tank during the second period. In particular in such a method variant, the use of a third tank makes the present invention particularly advantageous, because a corresponding interruption can be evened out by withdrawal of the cryogenic liquid from the third tank. It is therefore advantageously provided that the third tank retains a quantity of the cryogenic liquid that is at least as large as a quantity of the cryogenic liquid that can be stored in the first tank and/or in the second tank, or is at least large enough to bridge the switchover times, during which no liquid can be withdrawn from the first two containers, in order to permit continuous withdrawal. This makes it possible to continuously heat cryogenic liquid and to discharge this as air product, even if the contents of a completely full first or second tank must be returned to the distillation column system or discarded due to purity that does not correspond to a setpoint value.

In particular, the present invention finds application in air separation plants for the production of pure oxygen. In air separation plants of this type, the distillation column system has a first separation column and a second separation column. The first separation column is used to generate a fluid stream which is enriched to a first oxygen content and which is used in the second separation column to generate pure liquid oxygen that can be withdrawn from the second separation column at least in part as the cryogenic liquid. By using the third tank, the present invention permits continuous provision of high-purity oxygen.

In particular, the invention can be used in conjunction with the applicant's SPECTRA method, as described for example in US 2009/107177 A1. However, the invention is not restricted hereto. A method of this type involves using the first separation column to further generate a fluid stream enriched to a second oxygen content and a fluid stream enriched to a third oxygen content. The fluid stream enriched to the second oxygen content is advantageously withdrawn from the first separation column below the fluid stream enriched to the first oxygen content. It therefore has a higher oxygen content. The fluid stream enriched to the third oxygen content is advantageously withdrawn from the sump of the first separation column. The two fluid streams are then heated to different temperatures, in particular in a condenser of the first separation column and in a main heat exchanger, wherein the heated fluid stream enriched to the second oxygen content is at least partially compressed in a compressor coupled to an expansion machine, cooled and returned to the first separation column. By contrast, part of the fluid stream enriched to the third oxygen content is used to drive the expansion machine. For further details of a corresponding method, reference is made to the appended FIG. 1. A corresponding method proves to be particularly energetically advantageous.

Advantageously, for heating the cryogenic liquid which is subsequently provided as the air product, use is made of a main heat exchanger of the air separation plant. In addition or alternatively thereto, it is however also possible to use a special vaporizer. A corresponding vaporizer can in particular be used if the main heat exchanger of the air separation plant has insufficient capacity and/or if additional quantities of air products are to be provided, such as a corresponding heat exchanger is able to provide (if temporarily).

The present invention extends to an air separation plant which is designed for obtaining an air product. The air separation plant comprises a distillation column system and a tank system having a first tank and a second tank and has features as further described herein.

Advantageously, a corresponding air separation plant is designed for carrying out a method as explained in detail above. Therefore, at this point reference is expressly made to the corresponding features and advantages.

There follows a more detailed explanation of the invention, with reference to the appended drawings which illustrate preferred embodiments of the present invention.

DETAILED DESCRIPTION OF THE DRAWINGS

In the figures below, mutually corresponding elements are indicated with identical reference signs, and explanations will not be repeated, for the sake of clarity. In that context, FIGS. 2 and 3 respectively show tank systems as can be integrated into an air separation plant according to FIG. 1, or an air separation plant of a different design. In that context, the integration of the tank system is given by the elements also indicated in FIG. 1.

Figure 1:
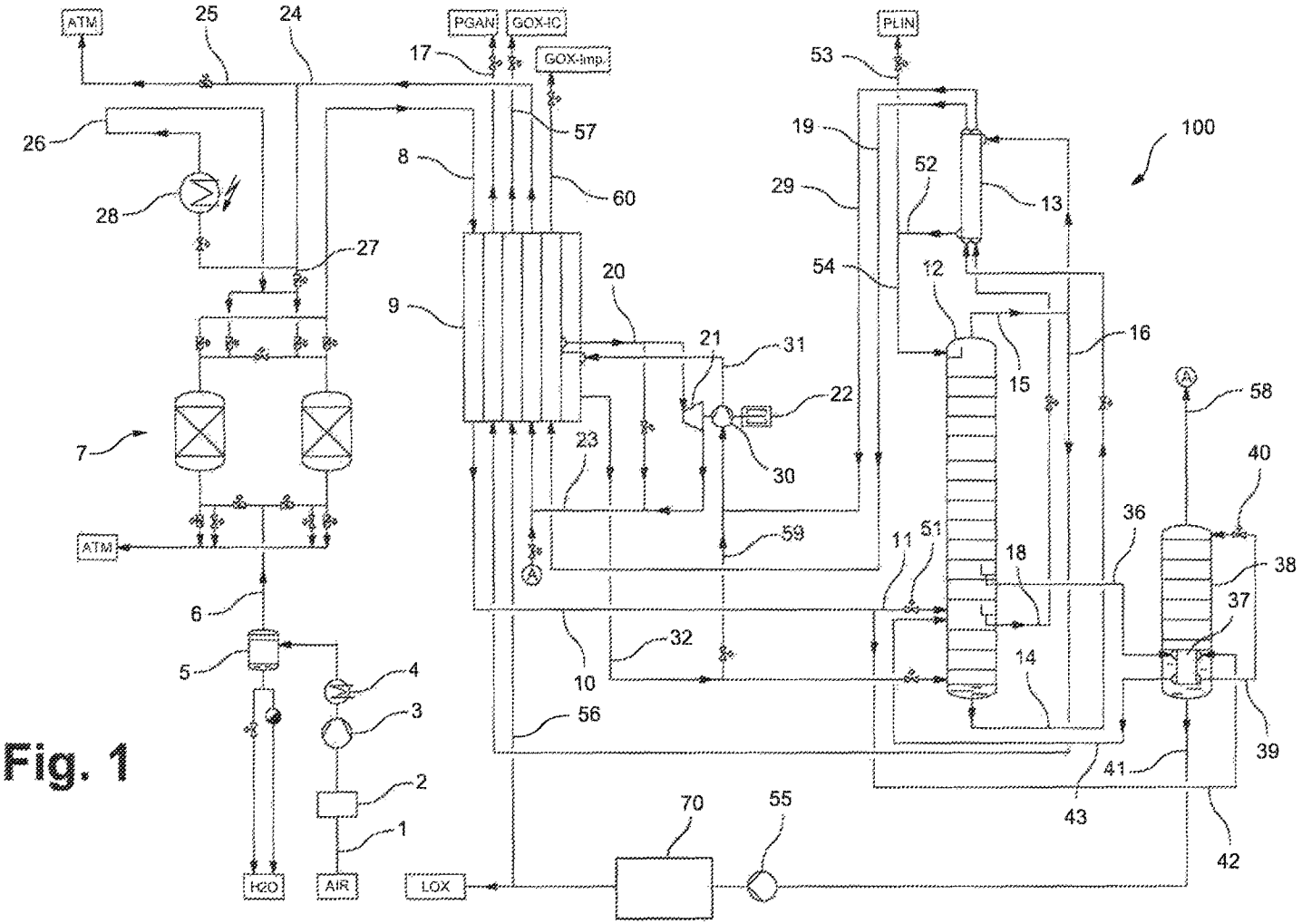
FIG. 1 shows an air separation plant according to one embodiment of the invention, in the form of a schematic plant diagram.

FIG. 1 shows, schematically, in the form of a schematic plant diagram, an air separation plant according to one embodiment of the present invention. The air separation plant is provided, as a whole, with the label 100.

Atmospheric air 1 (AIR) is drawn in, via a filter 2, by an air compressor 3 where it is compressed to an absolute pressure of between 6 and 20 bar, preferably approximately 9 bar. After flowing through an after-cooler 4 and a water separator 5 for separating off water (H2O), the compressed air 6 is purified in a purification apparatus 7 which has a pair of containers filled with adsorption material, preferably a molecular sieve. The purified air 8 is cooled to near dew point, and partially liquefied, in a main heat exchanger 9. A first part 11 of the cooled air 10 is introduced, via a throttle valve 51, into a first separation column 12. The injection preferably takes place several actual or theoretical trays above the sump.

The operating pressure of the single column 12 (at the top) is between 6 and 20 bar, preferably approximately 9 bar. Its top condenser 13 is cooled with a fluid stream 18 and a fluid stream 14. The fluid stream 18 is drawn off from an intermediate point which is several actual or theoretical trays above the air injection, or which is at the same height as the latter, and the fluid stream 14 is drawn off from the sump of the first separation column 12. In the context of the above explanations, the fluid stream 18 has been labelled a "fluid stream enriched to a second oxygen content", and the fluid stream 14 has been labelled a "fluid stream enriched to a third oxygen content".

Gaseous nitrogen 15, 16 is drawn off at the top of the first separation column 12 as the main product of the first separation column 12, is heated in the main heat exchanger 9 to approximately ambient temperature, and is finally drawn off via line 17 as a pressurized gas product (PLAN). Further gaseous nitrogen is fed through the top condenser 13. A part 53 of the condensate 52 obtained in the top condenser 13 can be obtained as liquid nitrogen product (PLIN); the remainder 54 is delivered to the top of the first separation column 12 as return flow.

The fluid stream 14 is vaporized in the top condenser 13 at a pressure of between 2 and 9 bar, preferably approximately 4 bar, and flows in gaseous form via a line 19 to the cold end of the main heat exchanger 9. It is withdrawn from the latter, at an intermediate temperature, in the form of the stream 20 and, in an expansion machine 21 which in the example shown takes the form of a turboexpander, is expanded, so as to perform work, to approximately 300 mbar above atmospheric pressure. The expansion machine 21 is mechanically coupled to a (cold) compressor 30 and to a brake device 22 which in the example shown takes the form of an oil brake. The expanded fluid stream 23 is heated in the main heat exchanger 9 to approximately ambient temperature. The hot fluid stream 24 is vented, as fluid stream 25, to the atmosphere (ATM) and/or is used as regeneration gas 26, 27, possibly after heating in the heating device 28.

The fluid stream 18 is vaporized in the top condenser 13 at a pressure of between 2 and 9 bar, preferably approximately 4 bar, and flows in gaseous form via a line 29 to the compressor 30 in which it is re-compressed to approximately the operating pressure of the first separation column 12. The re-compressed fluid stream 31 is cooled, in the main heat exchanger 9, back to the column temperature and finally fed, via the line 32, back to the sump of the first separation column 12. The treatment of the fluid streams 14 and 18 as described corresponds to the already-mentioned SPECTRA method.

A fluid stream 36, previously labelled a "fluid stream enriched to a first oxygen content", which is essentially free from heavy volatile contaminants, is drawn off in the liquid state from an intermediate point of the first separation column 12, which point is arranged 5 to 25 theoretical or actual trays above the air injection point. Where appropriate, the fluid stream 36 is sub-cooled in a sump vaporizer 37 of a second separation column 38, designed as a pure oxygen column, and is then delivered, via a line 39 and a throttle valve 40, to the top of the pure oxygen column 38. The operating pressure of the pure oxygen column 38 (at the top) is between 1.3 and 4 bar, preferably approximately 2.5 bar.

The sump vaporizer 37 of the second separation column 38 is also operated using a second part 42 of the cooled feed air 10. The feed air stream 42 is then at least partially, for example entirely, condensed and flows via a line 43 to the first separation column 12 where it is introduced approximately at the height of the injection of the remaining feed air 11, or into the column sump.

Figure 2:
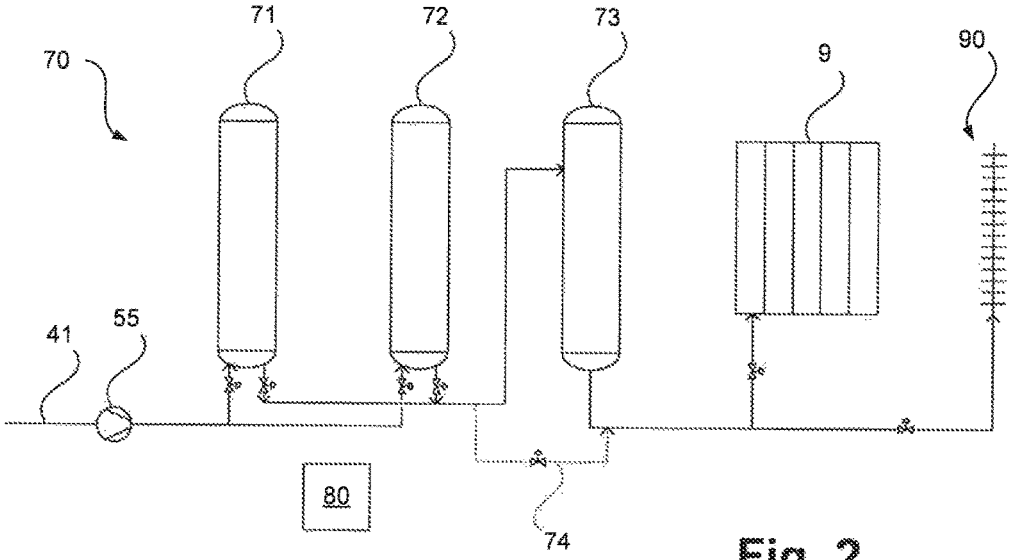
FIG. 2 shows a tank system according to one embodiment of the invention, in the form of a schematic plant diagram.
Figure 3:
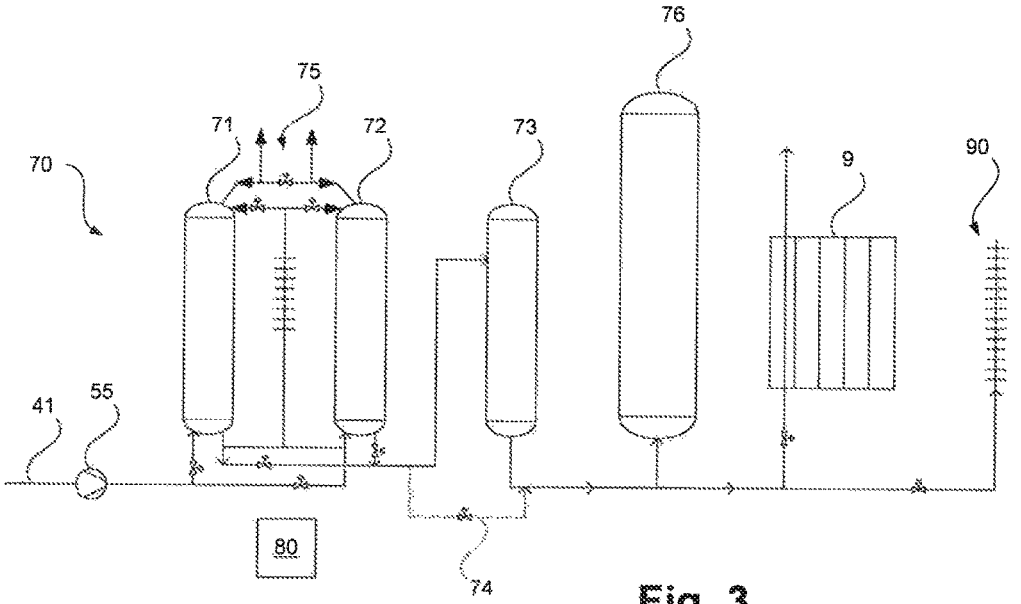
FIG. 3 shows a tank system according to one embodiment of the invention, in the form of a schematic plant diagram.

Pure oxygen is withdrawn as a cryogenic liquid 41 from the sump of the second separation column 38, is optionally raised by means of a pump 55 to an increased pressure of between 2 and 100 bar, preferably approximately 12 bar, and is introduced into a tank arrangement 70 which is shown in the subsequent FIGS. 2 and 3, After intermediate storage in the tank arrangement 70, the cryogenic liquid is fed via a line 56 to the cold end of the main heat exchanger 9 where it is vaporized at the increased pressure and is heated to approximately ambient temperature, and is finally obtained via line 57 as a gaseous product (GOX-IC).

A top gas 58 of the second separation column 38 is mixed into the previously mentioned expanded second fluid stream 23 (cf. connection A). Where relevant, part of the feed air is guided via a bypass line 59 to the inlet of the cold compressor 30 for surge prevention of the latter (what is referred to as anti-surge control).

When necessary, it is possible to withdraw from the air separation plant 100, upstream and/or downstream of the pump 55, liquid oxygen as liquid fraction (labelled LOX in the drawing). In addition, an external liquid, for example liquid argon, liquid nitrogen or liquid oxygen, also from a liquid tank, can be vaporized in the main heat exchanger 9 in indirect exchange of heat with the feed air (not shown in the drawing).

FIG. 2 shows, in the form of a schematic plant diagram, a tank system according to one embodiment of the invention, which can be used in an air separation plant 100 as illustrated in FIG. 1 and which as a whole is provided with the label 70.

The pump 55, already explained with reference to FIG. 1, is used to bring the cryogenic liquid of the fluid stream 41 from a first pressure level to a second pressure level. The first pressure level can in particular correspond to a pressure level at which a second separation column 38 (pure oxygen column) of an air separation plant 100, as shown in FIG. 1, can be operated. The second pressure level is for example 2 to 100 bar.

The pressurized fluid stream 41 is supplied to a first tank 71 or to a second tank 72. As explained many times, the tanks 71 and 72 are supplied with the cryogenic liquid of the fluid stream 41 in alternation with respect to one another, i.e. during a first period the cryogenic liquid of the fluid stream 41 is supplied to the first tank 71, and not to the second tank 72, and during a second period to the second tank 72, and not to the first tank 71. It is for example possible to provide a tank control 80 for controlling valves 71*a* and 72*a* used for this purpose.

As also explained many times, cryogenic liquid is always withdrawn from that tank 71, 72 which at that moment is not Supplied with cryogenic liquid of the fluid stream 41. This liquid is transferred, unheated, into a third tank 73. As already explained, it can also be provided, for example in the event of the third tank 73 being completely full, and as illustrated here by means of a line 74, to directly forward the corresponding fluid and supply it to heating. Heating of the fluid can, as also mentioned, take place for example in a main heat exchanger 9 of a corresponding air separation plant, for example the air separation plant 100 according to FIG. 1, and/or in an additional vaporizer 90.

FIG. 3 illustrates a tank system according to another embodiment of the invention, in the form of a schematic plant diagram. The tank system of FIG. 3 is also labelled 70, The tank system 70, which is illustrated in FIG. 3, is equipped with a pressurization vaporization device 75. A pump 55, as in the tank system 70 of FIG. 2 and/or in the air separation plant 100 of FIG. 1, is optionally provided here. In the case of pressurization vaporization, a corresponding pump 55 is generally omitted and the cryogenic liquid of the stream 41 is injected at the distillation pressure in the pure oxygen column 38, which corresponds to the "first pressure level", into the tanks 71 or, respectively, 72. The pressurization vaporization device 75 vaporises a fraction of the cryogenic liquid of the stream 41 which is withdrawn in liquid form from the tanks 71 or, respectively, 72. The vaporized and pressurized gas is fed to a top space of the tanks 71 or, respectively, 72. It is thus possible to dispense with the pump 55, and it is possible to use only pressurization vaporization.

As shown here, the cryogenic liquid used to provide the liquid air product is withdrawn in the liquid state from the third tank 73 and is vaporized in the main heat exchanger 9 and/or in the additional vaporizer 90, or is converted from the liquid to the supercritical state and is discharged from the air separation plant. The cryogenic liquid used to provide the liquid air product can however also be withdrawn in the liquid state from the third tank 73 and stored in liquid form in a fourth tank 76 until it is used. The details have already been explained. Further withdrawal points upstream and/or downstream of the third tank 73 are also possible.

The invention claimed is:

1. A method for obtaining an air product using an air separation plant having a distillation column system and a tank system with a first tank and a second tank, said method comprising:

withdrawing a cryogenic liquid from the distillation column system, storing the cryogenic liquid at least in part in the tank system, and using the cryogenic liquid at least in part as the air product, wherein the cryogenic liquid is supplied to the first tank and not to the second tank during a first period, and is supplied to the second tank and not to the first tank during a second period, and wherein the cryogenic liquid is withdrawn from the second tank and not from the first tank during the first period, and is withdrawn from the first tank and not from the second tank during the second period, wherein the tank system comprises an additional third tank, and the cryogenic liquid which is withdrawn from the second tank during the first period, and withdrawn from the first tank during the second period, is transferred, at least partially, unheated into the third tank, and wherein the air product is provided at least in part by using at least part of the cryogenic liquid transferred, unheated, into the third tank, and cryogenic liquid from the third tank used for providing the air product is withdrawn from the third tank in the liquid state, vaporized or converted from the liquid to the supercritical state, and discharged from the air separation plant, and/or cryogenic liquid from the third tank used for providing the air product is withdrawn from the third tank in the liquid state and stored in the liquid state in a fourth tank.

2. The method according to claim 1, wherein cryogenic liquid is supplied to the first tank and to the second tank at a first pressure level, and the cryogenic liquid is stored in the third tank at a second pressure level which is higher than said first pressure level.

3. The method according to claim 2, wherein said first pressure level is between 1.3 and 7 bar, and said second pressure level is between 2 and 100 bar.

4. The method according to claim 2, wherein the pressure of the cryogenic liquid is raised, in the liquid state, by using a pump, from the first pressure level to the second pressure level prior to introduction of the cryogenic liquid into the third tank.

5. The method according to claim 2, wherein the cryogenic liquid undergoes, in the first tank and in the second tank, pressurization vaporization to increase the pressure from said first pressure level to said second pressure level.

6. The method according to claim 2, wherein the pressure of the cryogenic liquid is raised, in the liquid state, to the first pressure level by using a pump prior to introduction of the cryogenic liquid into the first tank and the second tank.

7. The method according to claim 6, wherein the pressure of the cryogenic liquid is raised, in the liquid state, by using a pump, from the first pressure level to the second pressure level prior to introduction of the cryogenic liquid into the third tank.

8. The method according to claim 6, wherein the cryogenic liquid undergoes, in the first tank and in the second tank, pressurization vaporization to increase the pressure from said first pressure level to said second pressure level.

9. The method according to claim 1, wherein a purity of the cryogenic liquid, which is supplied to the first tank during the first period, is determined in the first tank and a purity of the cryogenic liquid, which is supplied to the second tank during the second period, is determined in the second tank.

10. The method according to claim 1, wherein the third tank retains a quantity of the cryogenic liquid that is at least as large as a quantity of the cryogenic liquid that can be stored in the first tank and/or in the second tank.

11. The method according to claim 1, wherein the distillation column system comprises a first separation column and a second separation column, wherein the first separation column generates a fluid stream which is enriched to a first oxygen content which is used in the second separation column to generate pure liquid oxygen that is withdrawn from the second separation column at least in part as the cryogenic liquid.

12. The method according to claim 11, wherein the first separation column further generates a fluid stream enriched to a second oxygen content and a fluid stream enriched to a third oxygen content, and said fluid stream enriched to a second oxygen content and said fluid stream enriched to a third oxygen content are then heated to different temperatures, wherein the heated fluid stream enriched to the second oxygen content is at least in part compressed in a compressor coupled to an expansion machine, cooled and returned to the first separation column, and part of the heated fluid stream enriched to the third oxygen content is expanded in the expansion machine.

13. The method according to claim 12, wherein said expansion machine is a turboexpander.

14. The method according to claim 12, wherein the fluid stream enriched to the second oxygen content is withdrawn from the first separation column below the point at which the fluid stream enriched to the first oxygen content is withdrawn, and the fluid stream enriched to the third oxygen content is withdrawn from the first separation column below the point at which the fluid stream enriched to the second oxygen content is withdrawn.

15. The method according to claim 12, wherein the fluid stream enriched to the second oxygen content has a higher oxygen content than the fluid stream enriched to the first oxygen content.

16. The method according to claim 12, wherein the fluid stream enriched to the second oxygen content and the fluid stream enriched to the third oxygen content are heated in a top condenser of the first separation column and in a main heat exchanger.

17. The method according to claim 1, wherein said air separation plant further comprises a main heat exchanger and/or a vaporizer that is used for heating the cryogenic liquid.

18. Air separation plant for obtaining an air product, said air separation plant comprising:

a distillation column system and a tank system having a first tank and a second tank, means for withdrawing a cryogenic liquid from the distillation column system and means for introducing at least part of the cryogenic liquid into the tank system to store at least part of the cryogenic liquid in the tank system, wherein said means for introducing includes means for supplying the cryogenic liquid to the first tank and not to the second tank during a first period, and for supplying the cryogenic liquid to the second tank and not to the first tank during a second period, and means for withdrawing the cryogenic liquid from the second tank and not from the first tank during the first period, and for withdrawing the cryogenic liquid from the first tank and not from the second tank during the second period, said tank system further comprising a third tank, and means for transferring the cryogenic liquid which is withdrawn from the second tank during the first period, and withdrawn from the first tank during the second period, at least temporarily and at least partially unheated into the third tank, means for withdrawing from the third tank the cryogenic liquid in the liquid state from the third tank to provide the air product, and means for vaporizing the cryogenic liquid or converting the cryogenic liquid from a the liquid to a supercritical state to thereby produce the air product, and means for discharging the air product from the air separation plant, and/or means for introducing the cryogenic liquid in the liquid state withdrawn from the third tank into a fourth tanks to store the cryogenic liquid in the liquid state in said fourth tank.

19. A method for obtaining an air product using an air separation plant having a distillation column system and a tank system with a first tank and a second tank, said method comprising:

withdrawing a cryogenic liquid from the distillation column system, storing the cryogenic liquid at least in part in the tank system, and using the cryogenic liquid at least in part as the air product, wherein the cryogenic liquid is supplied to the first tank and not to the second tank during a first period, and is supplied to the second tank and not to the first tank during a second period, and wherein the cryogenic liquid is withdrawn from the second tank and not from the first tank during the first period, and is withdrawn from the first tank and not from the second tank during the second period, wherein a purity of the cryogenic liquid, which is supplied to the first tank during the first period, is determined in the first tank and a purity of the cryogenic liquid, which is supplied to the second tank during the second period, is determined in the second tank, wherein the tank system comprises an additional third tank, and if the cryogenic liquid in the second tank has a purity corresponding to a setpoint, cryogenic liquid withdrawn from the second tank during the first period is transferred, at least partially, unheated into the third tank, and if the cryogenic liquid in the first tank has a purity corresponding to the setpoint, cryogenic liquid withdrawn from the first tank during the second period, is transferred, at least partially, unheated into the third tank, wherein, if cryogenic liquid is in stored in the third tank, the air product is provided at least in part by using at least part of the cryogenic liquid transferred, unheated, into the third tank, and cryogenic liquid from the third tank used for providing the air product is withdrawn from the third tank in the liquid state, vaporized or converted from the liquid to the supercritical state, and discharged from the air separation plant, and/or cryogenic liquid from the third tank used for providing the air product is withdrawn from the third tank in the liquid state and stored in the liquid state in a fourth tank.

20. The method according to claim 19, wherein, if the cryogenic liquid in the second tank has a purity below the setpoint, cryogenic liquid withdrawn from the second tank during the first period is sent to the distillation column system, and if the cryogenic liquid in the first tank has a purity below the setpoint, cryogenic liquid withdrawn from the first tank during the second period is sent to the distillation column system.

* * * * *